United States Patent [19]

Sincius et al.

[11] 4,172,728

[45] Oct. 30, 1979

[54] HIGH CONTRAST CONTINUOUS TONE DEVELOPER AND PROCESS OF USE

[75] Inventors: Joseph A. Sincius, Little Silver; William R. Pangratz, Parlin, both of N.J.

[73] Assignee: E. I. Du Pont de Nemours and Company, Wilmington, Del.

[21] Appl. No.: 861,184

[22] Filed: Dec. 16, 1977

[51] Int. Cl.[2] ..... G03C 5/30; G03C 5/32

[52] U.S. Cl. ..... 96/66 HD; 96/66.3; 96/66.4; 96/66.5; 96/60 BF

[58] Field of Search ..... 96/60 BF, 66 R, 66.3, 96/66.4, 66.5, 29 C, 33

[56] References Cited

U.S. PATENT DOCUMENTS

| | | | |
|---|---|---|---|
| Re. 29,111 | 1/1977 | Masseth | 96/66.4 |
| 1,925,557 | 9/1933 | Dundon | 96/66.4 |
| 2,271,229 | 1/1942 | Peterson et al. | 96/66.5 |
| 2,657,138 | 10/1953 | Robbins | 96/66.3 |
| 3,000,736 | 9/1961 | Karlson | 96/66 HD |
| 3,232,761 | 2/1966 | Allen et al. | 96/66 R |
| 3,552,969 | 1/1971 | Henn et al. | 96/66 R |
| 3,576,633 | 4/1971 | Henn et al. | 96/66.5 |
| 3,615,488 | 10/1971 | Drago et al. | 96/66.3 |
| 3,762,923 | 10/1973 | Sugiyama et al. | 96/61 M |
| 3,972,719 | 8/1976 | Vanreusel et al. | 96/66.4 |
| 3,984,243 | 10/1976 | Shimamura et al. | 96/66.3 |
| 4,022,621 | 5/1977 | Hayashi et al. | 96/66.3 |

FOREIGN PATENT DOCUMENTS

| | | | |
|---|---|---|---|
| 2202663 | 8/1973 | Fed. Rep. of Germany | 96/66 |
| 708479 | 5/1954 | United Kingdom | 96/66 HD |

OTHER PUBLICATIONS

Wiederman, Science et Industries Photographiques, vol. 32, No. 4, 1961, pp. 97–107.

*Primary Examiner*—Mary F. Kelley

[57] ABSTRACT

A photographic developer containing hydroquinone, an auxiliary developer such as phenidone, and high sulfite is formulated using an organic base such as diethanolamine. This is useful for processing litho film in rapid access machine processors to produce high contrast line and half-tone dot images from films processed therein.

6 Claims, No Drawings

HIGH CONTRAST CONTINUOUS TONE DEVELOPER AND PROCESS OF USE

This invention relates to photographic developers for silver halide emulsions and more particularly to continuous tone developers capable of producing lithographic sensitometry from silver halide films processed therein.

BACKGROUND OF THE INVENTION

In the process of developing imagewise exposed photographic silver halide emulsions, a combination of special emulsions and developers is required to give the high gradient, sharp toe, low fog and high top density characteristic of graphic arts products. Developers conventionally used in this process are based on hydroquinone as taught by Mason in "Photographic Processing Chemistry," Focal Press, pages 165–170 (1975). This combination of emulsion-developer is used mainly in the production of half-tone dot images and high contrast line images, conventionally used in letterpress, lithography and the like. It is known that these developers exhibit an induction period prior to development of the exposed sliver halide, whereafter so-called "infectious development" occurs giving rise to the high gradients necessary to produce useful images for graphic arts processes.

To produce high gradient in a half-tone dot, maximum density must be developed within the dot, but with little, if any, development in the unexposed emulsion surrounding the dot. Good dot quality is a combination of these factors, as pointed out by Mason:

(a) edge of dot must be sharp,
(b) little or no fog between dots,
(c) high dot density,
(d) no "halo" around the dots,
(e) infinite density gradient across the dot edge,
(f) optimum quality at normal processing conditions.

In order to enhance the infectious development which provides this dot quality, these developers contain an unusually low concentration of alkali sulfite. Since a low sulfite level renders a developer more prone to aerial oxidation, it is common to add carbonyl bisulfite compounds to act as a reservoir of sulfite. However, formaldehyde, which results from the dissociation of carbonyl bisulfite, reacts in a complex manner with the semiquinone, which is in equilibrium with the hydroquinone, which further tends to degrade the activity of the developer solution. These reactions are described by Childers, Photographic Science and Engineering, Vol. 15, page 480 (1971).

With the advent of processing machines and, more particularly, rapid access processing machines, the deficiencies of lithographic processing chemistry became more serious and apparent. Developer degradation was accelerated under machine processing conditions. The lag in the start of development caused by the long induction period of hydroquinone developers lengthened the processing time and delayed access to the finished product. While the induction period could have been eliminated, and the developing process speeded up, by using so-called "rapid access" developers containing both hydroquinone and an auxiliary developing agent such as phenidone or metol, the trouble is that these auxiliary developing agents are not useful in lithographic development because they cannot produce the necessary high gradient. The reason for this is that rapid access developers have a high sulfite content and this reacts destructively with semiquinone to prevent infectious development. Therefore, the relatively high level of sulfite in rapid access developers results in lower contrast than lith developers. It would obviously be desirable to combine the high gradient of lith developers with the processing convenience and stability of the rapid access developers.

SUMMARY OF THE INVENTION

This invention is directed to a high speed, rapid access developer formulation having improved resistance to air oxidation and anaerobic degradation, and to a process of producing high quality, half-tone screen dots from exposed silver halide emulsion elements processed therein. This developer formulation is a continuous tone aqueous developer solution having the following principal constituents:

(1) Hydroquinone or a substituted hydroquinone in combination with at least one other superadditive developing agent,
(2) An effective amount of a preservative or stablizier,
(3) An effective amount of an organic antifogging agent, and
(4) Sufficient alkanolamine to yield a pH of at least 10.0.

DETAILED DESCRIPTION OF THE INVENTION

Lithographic film elements processed in the developers of this invention will have low fog, a gradient of at least 5.0 calculated from the difference in relative Log E values measured at D=0.3 and D=3.5 on a Log E scale, and will produce high quality line and half-tone images. When processed in conjunction with conventional bleach-fix solutions e.g., thiosulfate solutions containing, for example, sodium ferric ethylene diamine tetraacetic acid (EDTA) or other combinations as described in "The Theory of the Photographic Process," 4th Edition, T. H. James, Editor, 1977, pages 450–453, the disclosure of which is hereby incorporated by reference, the gradient will be at least 6.0 and the dot quality will be equivalent or better than that of the same film processed in conventional half-tone chemistry. These results are very surprising since the art teaches that mixed developers cannot be used to process lithographic elements.

A particularly preferred formulation will have the following formula:

| Ingredient | Amount (g/liter) Range | Preferred |
|---|---|---|
| hydroquinone | 4–35 | 15 |
| phenidone | .04–3.5 | 0.15 |
| potassium sulfite | 15–60 | 45 |
| 5-nitroindazole | .09–5 | 0.3 |
| diethanolamine | 20–175 | 75 |
| pH | 10–12 | 10.3 |

Exposed lithographic films can be satisfactorily processed in machines containing these developer formulations to yield low fog, high gradient and high quality half-tone dot images.

Other dihydroxybenzenes and dihydroxynaphthalenes and substituted versions of these can be used in place of hydroquinone (1,4-dihydroxybenzene). These include, for example, the following compounds:

catechol (1,2-dihydroxybenzene)
pyrogallol (1,2,6-trihydroxybenzene)
1,2-dihydroxynaphthalene
chlorohydroquinone (or other halogen-substituted hydroquinones)
toluhydroquinone
1,4-dihydroxynaphthalene
Hydroquinone is preferred, however.

Phenidone (1-phenyl-3-pyrazolidone) is preferred as the superadditive developing agent. However, other substituted pyrazolidones as well as p-aminophenol and substituted p-aminophenol (e.g., methyl-p-aminophenol, or metol) can be used as well. Superadditive developing agents and their effects are fully discussed in the above referenced Mason article.

Antifogging agents are legion in number, but 5-or 6-nitroindazole is preferred in the practice of this invention. However, any of the conventional antifogging agents which will eliminate the fog and still provide the necessary lith effects in a formula of this type can be employed.

Alkanolamines (e.g., mono-, di-, and triethanolamines) are preferred as the alkaline agent in order to achieve the preferred pH range. Inorganic alkali agents (e.g., KOH) will function but the increased pH reduces the stability of the developer formulation and hence, these are not preferred.

The alkali sulfites (e.g., sodium or potassium sulfite) are the most commonly used preservatives against aerial oxidation and subsequent developer degradation. These compounds are cheap and effective and hence are preferred within the formulation of this invention.

Other adjuvants well known to those skilled in the art of developer formulation may be added to this developer to perform the various functions for which they are intended. These include restrainers, such as the soluble halides (e.g., KBr), solvents (e.g., ethylene glycol), buffers, such as the amine salts of weak acids (e.g., sulfites, carbonates, borates, etc.), other development accelerators (e.g., polyethylene glycols), preservatives and the like.

This formulation may also be prepared in a concentrated form and then diluted to a working strength just prior to use. Concentrated solutions for automatic processing are widely used by those who utilize rapid access processing machines. The developing solution may be sold in two parts. These parts are then combined and diluted to the desired strength with water and placed in the developing tank of the machine.

Any of the known silver halide emulsions may be processed in the developer formulation of this invention. Those emulsions of the lithographic type (e.g., mainly silver chloride with silver bromide and/or silver iodide in smaller amounts) processed within this formulation will produce high quality half-tone dots. These are preferably gelatin/ethyl acrylate - bromochloride emulsions (e.g., about 30 mole % AgBr and about 70 mole % AgCl, but may also contain small amounts of AgI) of the type described in U.S. Pat. No. 3,785,822 and the references cited therein.

All that is necessary to produce a developing solution which will yield good half-tone dot quality in rapid access development is to balance the developers listed above with the preservative and antifoggant at the proper pH. The novel results achieved could not have been predicted from a knowledge of the prior art nor were they obvious from any combination thereof since the art has taught directly away from the notion that a developer formulation of the type commonly thought to be useful only in processing continuous tone elements could also be used to achieve half-tone lithographic results.

The half-tone lithographic results noted are very similar to those produced by exposed elements processed in conventional lith chemistry (e.g., all hydroquinone-low sulfite-carbonylbisulfite type). Lithographic film elements processed in this novel developer will exhibit good speed, very low fog, high gradient (e.g., at least 5.0 taken between D=0.3 to 3.5 on a Log E Scale), and high top density, and thus yield good, sharp half-tone dots. Additionally, the combination of film-/developer exhibits essentially no induction period and thus is suitable for rapid access processors. When films developed in this formulation are further processed in an aqueous bleach-fixer (e.g., sodium-ferric ethylene diamine tetraacetic acid plus a suitable fixing agent), the gradients will exceed 6.0 and the half-tone dots are equal to if not better than those prepared in a conventional lithographic developer. Additionally, the formulations described herein can be used under all conditions of processing including hand or tray, machine, rapid access machine and the like. Finally, these formulations are stable and are resistant to aerial oxidation. Since no formaldehyde is present in either a free or combined state, the degradation reactions noted in the prior art formulation do not occur.

This invention will now be illustrated by the following examples:

EXAMPLE 1

The following developer formulation, illustrative of this invention, was prepared:

| Ingredient | Amount |
|---|---|
| Water | 600 ml. |
| potassium sulfite | 45 g. |
| diethanolamine | 75 g. |
| hydroquinone | 15 g. |
| potassium bromide | 2.25 g. |
| phenidone | 0.15 g. |
| 5-nitroindazole | 0.3 g. |
| ethylene glycol | 79 g. |
| water to | 1000 ml. |
| pH | 10.3 |

A control developer, which had the same formulation as the above, but without the diethanolamine and having a pH of about 9.6, was also made up. Cronalith Control Strips, (trademark of E. I. du Pont de Nemours and Company, Wilmington, Delaware for preexposed strips of fully sensitized chlorobromide emulsion coated on a polyester base) which had been further sensitized with an orthochromatic dye, were used to test developer activity. Each strip was pre-exposed with a $\sqrt{2}$ density step wedge and a numbered Relative Log E Scale. Samples of control strips were tray processed in each of the above developers as well as samples of commercially available developers (Chemco Powermatic and EK S-55) at 90° F. for 30 seconds followed by conventional fixing, washing and drying. The sensitometry of these washed and dried elements, as determined from the readings on a MacBeth Densitometer, was as follows:

| Developer Used | B+Fog | Sensitometry (at D=3.5) Relative Speed | ∇ Gradient (3.5-0.3D) |
|---|---|---|---|
| Control | .05 | 100 | 4.4 |
| Chemco Powermatic[1][3] | .06 | 129 | 4.8 |
| EK S-55[2][3] | .05 | 105 | 4.2 |
| Of this Invention | .05 | 297 | 8.0 |

[1]Chemco Photoproducts Co., Glen Cove, N.Y.
[2]Eastman Kodak Co., Rochester, N.Y.
[3]These developers are commercially available continuous tone developers in which hydroquinone and phenidone are the developing agents.

Thus, one can see that the developer of this invention produces superior gradient and improved speed as compared to the other formulations.

EXAMPLE 2

The experiment described in Example 1 was repeated except that processing was accomplished using a Pakoquick ® 24 processor (an automatic film processor manufactured by Pako Corp., Minneapolis, Minn.) at 110° F., 50 in./min., with a conventional fix-wash-dry step. Total processing time (dry-to-dry) was 84 seconds. Sensitometric results follow:

| Developer Used | B+Fog | Sensitometry Rel. Speed | Gradient |
|---|---|---|---|
| Control | .06 | 100 | 4.7 |
| Chemco Powermatic | .06 | 83 | 4.9 |
| Of this Invention | .06 | 185 | 8.2 |

The film strip processed in the developer of this invention had the high gradient and low fog necessary to produce superior half-tone dots while that processed in developers similar to this invention did not produce a gradient high enough to yield acceptable dot quality.

EXAMPLE 3

The following stock solution developer formulation was prepared:

| | |
|---|---|
| water | 750 ml. |
| potassium sulfite | 45 g. |
| hydroquinone | 15 g. |
| potassium bromide | 2.25 g. |
| phenidone | 0.15 g. |
| 5-nitroindazole | 0.3 g. |
| ethylene glycol | 71 g. |
| water | to 950 ml. |

Aliquots of this formulation were then taken and the pH adjusted with ingredients shown below. In each case, the pH was kept between 10–12 and sample film strips (see Example 1) processed therein (90° F., 30 sec.). The developed, fixed, washed samples gave the following results:

| Sample | Sensitometry B+Fog | Rel. Speed | Gradient |
|---|---|---|---|
| Control, no alkali added | 0.02 | too low to calc. | too low to calc. |
| pH adjusted with KOH | 0.03 | 100 | 7.3 |
| pH adjusted with diethanolamine | 0.03 | 107 | 8.0 |
| pH adjusted with monoethanolamine | 0.04 | 151 | 9.6 |
| pH adjusted with triethanolamine | 0.07 | 151 | 9.4 |

Superior results are obtained when alkanolamines are used to suitably adjust the pH of the developer of this invention.

EXAMPLE 4

In order to test the effectiveness of this developer solution without an antifoggant, the following stock solution was prepared:

| | |
|---|---|
| water | 700 ml. |
| potassium sulfite | 45 g. |
| diethanolamine | 75 g. |
| hydroquinone | 15 g. |
| potassium bromide | 2.25 g. |
| phenidone | 0.15 g. |
| ethylene glycol | 61 g. |
| water to | 925 ml. |

Various antifoggants were added to aliquots of this solution at a level equivalent to about 0.3 g./liter of developer and sample film strips processed therein (90° F., 30 seconds) as described in Example 1. The fixed, washed and dried samples gave the following results:

| Sample | Sensitometry B+Fog | Rel. Speed | Gradient |
|---|---|---|---|
| Control-no antifoggant | 0.15 | 100 | 5.2 |
| 5-nitroindazole | 0.04 | 100 | 9.4 |
| 6-nitroindazole | 0.05 | 90 | 7.3 |
| 5-nitrobenzimidazole | 0.04 | 61 | 6.4 |

Since low fog and high gradient are necessary to achieve the required dot quality it can be seen from this example the exact balancing of developer activity and gradient and fog is necessary to achieve the desired results.

EXAMPLE 5

Three sample strips of a lithographic film element made from a chlorobromide emulsion (ca. 70 mole percent AgCl and ca. 30 mole percent AgBr brought to its optimum sensitivity by digestion and gold and sulfur salts and containing an orthochromatic sensitizing dye) were exposed through a $\sqrt{2}$ density step wedge and a 120 line magenta square dot screen on a Robertson Camera (Xenon light source through a W-2 Mylar ® U.V. absorber). The main exposure was as shown below. A second "flash" exposure was also made to a flash lamp having a Series 00 Yellow Filter plus a 1.0 neutral density filter. The duration of this exposure was as shown.

Each sample was then machine processed as indicated:

| Exposure Time (Sec.) | | | Development | |
|---|---|---|---|---|
| Sample | Main | Flash | Time(sec.) | Temp. (°F.) |
| 1 | 40 | 25 | 22.5 | 108 |
| 2 | 19 | 50 | 18 | 110 |
| 3 | 22 | 65 | 18 | 110 |

The developer in the processor used for Sample 1 had the following ingredients:

| | |
|---|---|
| water | 750 ml. |
| potassium sulfite | 225 g. |
| potassium hydroxide | 27 g. |
| phenidone | 1 g. |
| hydroquinone | 56 g. |
| benzotriazole | 4.02 g. |
| ethylene glycol | 95 ml. |
| sodium carbonate | 20 g. |
| KBr | 10 g. |
| $H_2O$ | to 1 liter |
| pH | 10.9 |

This formulation also contained wetting agents, preservatives, etc. as known to those skilled in the art. A standard fixer (aqueous sodium thiosulfate) was also used in the process of this sample.

Samples 2 and 3 were processed in the formulation of Example 1. Sample 2 had the same fixer of Sample 1 while Sample 3 used the same fixer but additional containing 3 oz./gallon of a 48% aqueous solution of ammonium-ferric-ethylene diamine tetraacetic acid [EDTA] (Ciba-Geigy Corp.) as a bleach agent. The dot quality of each sample was evaluated with the following results:

| Sample | Dot Quality |
|---|---|
| 1 | Unacceptable - ragged, no density in shadow (5–10%) dots. Soft edges. Heavily veiled. |
| 2 | Good quality - sharp edges. Some veiling. |
| 3 | Excellent quality - sharp edges. Very little veiling. |

This experiment demonstrates the utility of the developer of this invention and its ability to produce good to excellent dot quality in continuous tone processing.

EXAMPLE 6

Samples of the same film as that described in Example 5 were exposed as described therein. These exposed samples were tray processed in the following developer solutions:

A—Control developer of Example 5
B—Chemco Powermatic
C—Of this Invetion (same as Example 1)

Two sample strips were processed in each developer solution (90° F., 30 seconds). One sample from each was fixed conventionally (90° F., 30 seconds) and one sample fixed in the bleach-fix solution of Example 5 (but at 1.6 oz./gallon) with the following results:

| Sample Developer | Fixer | B+Fog | Sensitometry Rel. Speed (at D=3.5) | ∇ Gradient (3.5–0.3) | Dot Quality[1] |
|---|---|---|---|---|---|
| A | Standard | 0.03 | 100 | 4.5 | 10 |
| A | +Bleach-fix | 0.03 | 70 | 4.8 | 8–9 |
| B | Standard | 0.03 | 124 | 4.8 | 6 |
| B | +Bleach-fix | 0.02 | 100 | 5.7 | 5–6 |
| C | Standard | 0.03 | 237 | 8.4 | 4 |
| C | +Bleach-fix | 0.03 | 175 | 8.9 | 3–4 |

[1]Dot quality is rated on a scale of 1–10 with 1 being best and 10 worst.

The effect of the bleach-fixer are shown in this example. All of the developers were improved in dot quality when fixed in this solution. However, only those produced by the developer of this invention had the superior dot quality.

We claim:

1. A high contrast continuous tone developer consisting essentially of
   (a) hydroquinone in amount of 4–35 grams per liter,
   (b) phenidone in an amount of 0.04–3.5 grams per liter,
   (c) potassium sulfite in an amount of 15–60 grams per liter,
   (d) 5-nitroindazole in an amount of 0.09–5 grams per liter,
   (e) diethanolamine in an amount of 20–175 grams per liter, and
   (f) water sufficient to make up one liter, said developer having a pH of 10–12.

2. A high contrast continuous tone developer consisting essentially of
   (a) hydroquinone in an amount of 15 grams per liter,
   (b) phenidone in an amount of 0.15 gram per liter,
   (c) diethanolamine in an amount of 75 grams per liter
   (d) potassium sulfite in an amount of 45 grams per liter,
   (e) potassium bromide in an amount of 2.25 grams per liter,
   (f) 5-nitroindazole in an amount of 0.3 gram per liter, and
   (g) ethylene glycol in an amount of 75 grams per liter, and
   (h) water sufficient to make up 1 liter, said developer having a pH of 10–12.

3. A high contrast continuous tone developer consisting essentially of:
   (a) hydroquinone or substituted hydroquinone in an amount of 4–35 grams per liter,
   (b) an auxiliary superadditive developing agent in an amount of 0.04 to 3.5 grams per liter,
   (c) an alkali sulfite in an amount of 15 to 60 grams per liter,
   (d) an organic antifogging agent selected from the group consisting of 5-nitroindazole, 6-nitroindazole, and 5-nitrobenzimidazole, in an amount of 0.09 to 5 grams per liter,
   (e) an alkanolamine in an amount of 20 to 175 grams per liter, and
   (f) water surficient to make up one liter, said developer having a pH of 10–12.

4. A process for preparing a high contrast silver image having a gradient of at least 5.0 calculated from the difference in relative Log E values measured at densities of 0.3 and 3.5 on a Log E Scale, comprising the steps of exposing a photosensitive silver halide emulsion and then developing the resultant image in a high contrast continuous tone developer consisting essentially of
   (a) hydroquinone in an amount of 4–35 grams per liter, (b) phenidone in an amount of 0.04–3.5 grams per liter, (c) potassium sulfite in an amount of 15–60 grams per liter, (d) 5-nitroindazole in an amount of 0.09–5 grams per liter, (e) diethanolamine in an amount of 20–175 gras per liter, and (f) water sufficient to make up one liter, said developer having a pH of 10–12.

5. A process for preparing a high contrast silver image comprising the steps of exposing a photosensitive silver halide emulsion, developing the resultant image in a high contrast continuous tone developer, and the processing the developed image in a bleach-fix solution to produce a litho film having a gradient of at least 6.0 calculated from the difference in relative Log E values measured at densities of 0.3 and 3.5 on a Log E Scale, said developer consisting essentially of (a) hydroquinone in an amount of 4–35 grams per liter, (b) phenidone in an amount of 0.04–3.5 grams per liter, (c) potassium sulfite in an amount of 15–60 grams per liter, (d) 5-nitroindazole in an amount of 0.09–5 grams per liter, (e) diethanolamine in amount of 20–175 grams per liter, and (f) water sufficient to make up one liter, said developer having a pH of 10–12.

6. In a process of development of form half-tone dot images wherein an element containing a photosensitive silver halide emulsion is exposed imagewise and developed in the developer of claim 3.

* * * * *

UNITED STATES PATENT OFFICE

CERTIFICATE OF CORRECTION

PATENT NO. : 4,172,728

DATED : October 30, 1979

INVENTOR(S) : Joseph A. Sincius and William R. Pangratz

It is certified that error appears in the above-identified patent and that said Letters Patent are hereby corrected as shown below:

Claim 6, line 1 reads "In a process of development of form half-tone dot..." and it should read --A process of development to form half-tone dot...--

Signed and Sealed this

*Eighteenth* Day of *March 1980*

[SEAL]

*Attest:*

SIDNEY A. DIAMOND

*Attesting Officer*

*Commissioner of Patents and Trademarks*